US009243461B1

(12) United States Patent
Barnes

(10) Patent No.: US 9,243,461 B1
(45) Date of Patent: Jan. 26, 2016

(54) CATWALK MECHANISM AND METHOD FOR INSTALLING TUBULARS ON A DRILL STRING

(71) Applicant: LOADMASTER UNIVERSAL RIGS, INC., Houston, TX (US)

(72) Inventor: R. Michael Barnes, Magnolia, TX (US)

(73) Assignee: LOADMASTER UNIVERSAL RIGS, INC., Houston, TX (US)

( * ) Notice: Subject to any disclaimer, the term of this patent is extended or adjusted under 35 U.S.C. 154(b) by 363 days.

(21) Appl. No.: 13/736,827

(22) Filed: Jan. 8, 2013

Related U.S. Application Data

(60) Provisional application No. 61/587,476, filed on Jan. 17, 2012.

(51) Int. Cl.
*E21B 19/15* (2006.01)

(52) U.S. Cl.
CPC ..... *E21B 19/155* (2013.01)

(58) Field of Classification Search
CPC ..... E21B 19/15; E21B 19/155; E21B 19/06; E21B 19/14
See application file for complete search history.

(56) References Cited

U.S. PATENT DOCUMENTS

| | | | | | |
|---|---|---|---|---|---|
| 3,143,220 | A * | 8/1964 | Goepfert | 414/22.53 |
| 3,193,116 | A * | 7/1965 | Kenneday et al. | 414/22.55 |
| 3,795,326 | A * | 3/1974 | Neilon et al. | 414/22.58 |
| 3,929,235 | A * | 12/1975 | Howard et al. | 414/22.67 |
| 4,386,883 | A * | 6/1983 | Hogan et al. | 414/22.61 |
| 4,765,401 | A * | 8/1988 | Boyadjieff | 166/77.53 |
| 5,049,020 | A * | 9/1991 | McArthur | 414/22.51 |
| 6,533,519 | B1 * | 3/2003 | Tolmon et al. | 414/22.54 |
| 2003/0123955 | A1 * | 7/2003 | Eastcott | 414/22.54 |
| 2005/0152772 | A1 * | 7/2005 | Hawkins, II | 414/22.54 |
| 2006/0045655 | A1 * | 3/2006 | Wells | 414/22.61 |
| 2006/0285941 | A1 * | 12/2006 | Fikowski et al. | 414/22.54 |
| 2009/0252576 | A1 * | 10/2009 | Gerber et al. | 414/22.54 |
| 2009/0263221 | A1 * | 10/2009 | Oldershaw | 414/495 |
| 2010/0135750 | A1 * | 6/2010 | Tarique | 414/22.54 |
| 2010/0308609 | A1 * | 12/2010 | LaValley et al. | 294/81.61 |
| 2013/0048310 | A1 * | 2/2013 | Beebe | 166/380 |

* cited by examiner

*Primary Examiner* — Frederick L Lagman
(74) *Attorney, Agent, or Firm* — Buskop Law Group, PC; Wendy Buskop

(57) ABSTRACT

A method for moving tubulars from a horizontal position to a vertical position to perform one or more drilling operations, production operations, workover operations, or combinations thereof can include using a catwalk positioned adjacent to a drilling rig and a top drive connected to the drilling rig to hoist tubulars from the horizontal position to the vertical position.

3 Claims, 4 Drawing Sheets

FIGURE 4

| | |
|---|---|
| RAISING A CATWALK TO AN ELEVATION EQUIVALENT TO A DRILL FLOOR OF A DRILLING RIG WHEREIN THE RIG HAS A TOP DRIVE SLIDABLY CONNECTED TO THE MAST, AND A DRILL LINE CONNECTED FROM A DRAWWORKS TO THE TOP DRIVE THROUGH THE CROWN | 601 |
| ROLLING A TUBULAR FROM A PIPE RACK OR A BUCKING MACHINE TO ONE OF A PLURALITY OF LOADING ARMS MOUNTED TO THE TRAILER | 603 |
| RAISING THE LOADING ARM TO RAISE THE TUBULAR TO A POSITION FLUSH WITH THE CATWALK | 605 |
| ROLLING THE TUBULAR ONTO THE CATWALK FROM THE LOADING ARM | 607 |
| EXTENDING A PLURALITY OF TOP DRIVE LINKS FROM THE TOP DRIVE, WHEREIN THE TOP DRIVE LINKS HAVE AN ELEVATOR | 609 |
| GRABBING A FIRST END OF THE TUBULAR WITH THE ELEVATORS | 611 |
| USING THE DRAWWORKS AND DRILL LINE TO HOIST THE TUBULAR CONNECTED TO THE TOP DRIVE WHILE MAINTAINING A CONNECTION BETWEEN THE TUBULAR AND THE CATWALK | 613 |
| GRABBING THE TUBULAR ON A SECOND END WITH A TAILING ARM CONNECTED TO A PIVOTING TUBULAR GRABBER, WHEREIN THE TAILING ARM IS CONNECTED TO THE MAST | 615 |
| PIVOTING THE TAILING ARM TO GUIDE THE SECOND END OF THE TUBULAR TO A WELL CENTER WHILE MAINTAINING THE SECOND END OF THE TUBULAR ADJACENT THE DRILL FLOOR | 617 |
| CONNECTING HYDRAULIC TONGS TO THE SECOND END OF THE TUBULAR | 619 |
| LOWERING THE TOP DRIVE WITH THE DRAWWORKS AND DRILL LINE, ENABLING THE SECOND END OF THE TUBULAR TO CONNECT WITH AN END OF A DRILL STRING IN THE WELLBORE | 621 |
| DISENGAGING THE TUBULAR FROM THE CATWALK | 623 |
| MAKING UP THE JOINT BETWEEN THE TUBULAR AND THE DRILL STRING WITH THE HYDRAULIC TONGS | 635 |
| USING A DIFFERENT LOADING ARM TO RAISE AN ADDITIONAL TUBULAR FROM THE PIPE RACK OR BUCKING MACHINE TO THE CATWALK TO SEQUENTIALLY PERFORM STEP 601 TO STEP 635 WHEN THE LOADING ARM IS ROLLING THE TUBULAR ONTO THE CATWALK | 637 |

CATWALK MECHANISM AND METHOD FOR INSTALLING TUBULARS ON A DRILL STRING

CROSS REFERENCE TO RELATED APPLICATION

The current application claims priority to and the benefit of U.S. Provisional Patent Application Ser. No. 61/587,476 filed Jan. 17, 2012, entitled "CATWALK MECHANISM." This reference is hereby incorporated in its entirety.

FIELD

The present embodiments generally relate to a method for moving tubulars from a horizontal position to a vertical position and a catwalk mechanism which can be completely automated for safe deployment of tubulars to a drilling rig for formation of a drill string.

BACKGROUND

A need exists for a method that utilizes an easy to use automated mechanism for centering and placing tubulars down a wellbore.

A need exists for a mechanism that can receive tubulars of various diameters as it is delivered to a rig site, horizontal near ground level, and present it to the drilling system in a manner that allows the hoisting system in a configuration. A further need exists for a method that allows tubulars to be safely and efficiently moved from the horizontal position to the vertical position.

The present embodiments meet these needs.

BRIEF DESCRIPTION OF THE DRAWINGS

The detailed description will be better understood in conjunction with the accompanying drawings as follows:

FIG. 4 depicts a flow diagram of an embodiment of a method for moving tubulars from the horizontal position to the vertical position to perform one or more drilling operations, production operations, workover operations, or combinations thereof.

Figure 1:
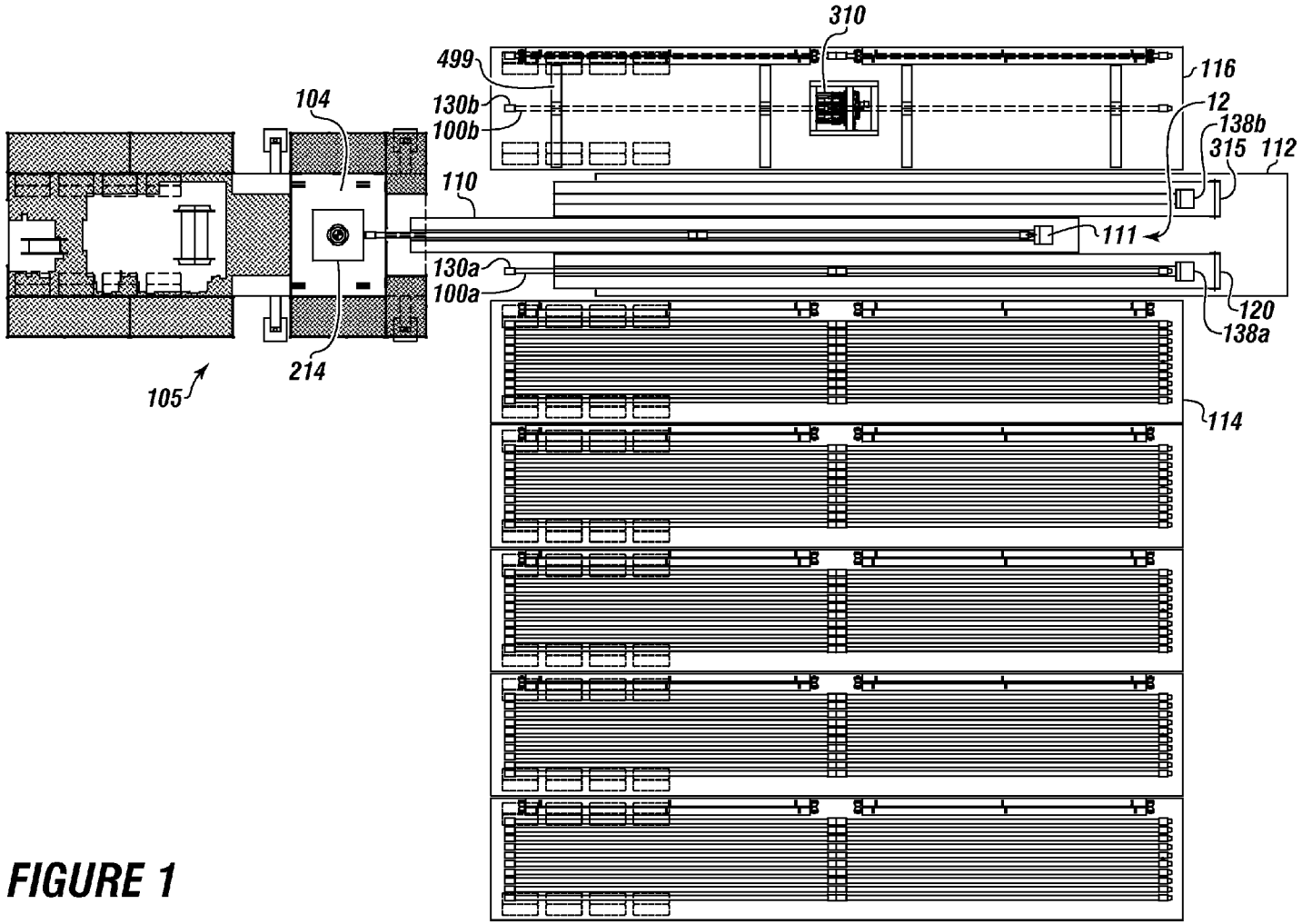
FIG. 1 depicts a top view of a catwalk mechanism according to one or more embodiments.

The present embodiments are detailed below with reference to the listed Figures.

DETAILED DESCRIPTION OF THE EMBODIMENTS

Before explaining the present apparatus and method in detail, it is to be understood that the apparatus and method are not limited to the particular embodiments and that it can be practiced or carried out in various ways.

The present embodiments relate to a method for moving tubulars from a horizontal position to a vertical position. The method can include moving the tubulars to perform one or more drilling operations, production operations, workover operations, or combinations thereof.

The method can include raising a catwalk to an elevation equivalent to a drill floor of a drilling rig. The catwalk can be connected with a trailer. The catwalk can be mounted on, secured to, or otherwise engaged with the trailer.

The method can include rolling a tubular from a pipe rack to a feed start position on a loading arm. The tubular can be rolled using a machine in the pipe rack.

In one or more embodiments, the pipe rack can be a pipe tub.

The method can include raising the loading arm to a position flush with the raised catwalk. The tubular can be moved onto the catwalk.

The method can include extending a top drive link from a top drive mounted to a mast on the drilling rig. The top drive link can be an elevator link.

The method can include grabbing a pipe collar on the tubular with the top drive link.

The method can include hoisting one end of the tubular using the top drive while the lower portion of the tubular can be guided by the catwalk.

The method can include grabbing a portion of the tubular with a tubular grabber on a tailing arm before the tubular disengages the catwalk.

The method can include repeating the steps in sequence until all tubulars are installed in a wellbore.

The method can further include installing two pairs of outriggers on the trailer, which can stabilize the trailer prior to raising the catwalk.

The method can further include using a raising mechanism, which can raise the catwalk from the trailer.

The method can further include using a loading arm feed start positioner, which can be mounted on each loading arm, and using a catwalk feed start positioner located on the catwalk.

The loading arm feed start positioner can correctly position the tubular for the top drive link, and which can engage the tubular to prevent the tubular from sliding.

The method can also include using the catwalk feed start positioner, which can be slidably engaged with the tubular, such as to prevent backsliding of the tubular off the loading arm or the catwalk.

The method can also include rolling the tubular from a bucking machine trailer to the feed start position on the loading arm.

The invention also relates to a catwalk mechanism for a drilling rig. The catwalk mechanism is for lifting tubular for a drilling rig that has a mast with crown. The mast can connect to a subbase. A drill floor can be on the rig located between the mast and the subbase. The mast can have a top drive suspended by the hoisting system, and slidably guided within the mast. A drill line can connect through the hoisting system from a drawworks to the top drive through the crown.

The catwalk mechanism can have a catwalk and a raising mechanism. The raising mechanism can be a plurality of hydraulic cylinders connected to the catwalk for lifting the catwalk from a trailer to a location near the height of the drill floor of the drilling rig. The catwalk mechanism can have a plurality of loading arms mounted to the trailer.

A hydraulic power unit can connect to a plurality of loading arms of the catwalk mechanism and to the raising mechanism for lifting and lowering the loading arms and catwalk.

An elevator can be connected to top drive links of the top drive. The elevators can be used to hydraulically engage individual tubulars as the individual tubulars are sequentially raised by the loading arms in series.

A tailing arm can be attached to the mast on one end, and on the other end the tailing arm has a tubular grabber for grabbing or guiding the lower end of a tubular, opposite the end lifted by the top drive. The tailing arm can move the tubular to a well center while allowing the tubular to continue to be lifted by the top drive.

In embodiments, the catwalk mechanism can have a loading arm feed start positioner use in positing tubulars on each loading arm. The loading arm feed start positioner can be mounted on the trailer.

The catwalk mechanism can include a catwalk feed start positioner located on the catwalk to prevent individual tubulars raised by the catwalk from sliding backward and falling off the catwalk, and to aid in correctly positioning each tubular for being raised by the top drive.

Turning now to the Figures, FIG. 1 depicts a top view of a catwalk mechanism according to one or more embodiments.

The catwalk mechanism 12 can include a catwalk 110 that is shown connected to a trailer 112. The trailer 112 can be positioned adjacent to a drilling rig 105. The drilling rig 105 can have a drill floor 104 and hydraulic tongs 214.

It can be seen that the tubulars 100*a* and 100*b* can each have pipe collars 130*a* and 130*b*. In one or more embodiments, the tubulars can come form one source or multiple sources.

In this Figure, a first tubular 100*a* is shown coming from a pipe rack 114. The pipe rack 114 can be adjacent the trailer 112.

The second tubular 100*b* is shown coming from a bucking machine 116. The bucking machine 116 can be driven by a motor 310. The bucking machine 116 can include a conveyor 499 for rolling a tubular or moving a tubular towards the catwalk mechanism for lifting the tubular up to the drilling rig top drive.

In this Figure, the first tubular 100*a* can roll into a first loading arm 120 and the second tubular 100*b* can roll into the second loading arm 315.

The first loading arm 120 can include a first loading arm feed start positioner 138*a* and the second loading arm 315 can include a second loading arm feed start positioner 138*b*.

The first loading arm 120 can selectively place tubulars from the pipe rack 114 onto the catwalk 110 then as the tubular is moved out of the way, the second loading arm 315 can selectively place a tubular from the bucking machine 116 onto the catwalk 110, allowing a feed to a drilling rig in 50 percent less time than other types of placement.

A catwalk feed start positioner 111 can slide along the catwalk 110 to aid in controlling the movement of the tubulars as the tubulars move along the catwalk 110. The catwalk feed start positioner 111 can be moved by a hydraulic power unit, which is shown in FIG. 2.

Figure 2:
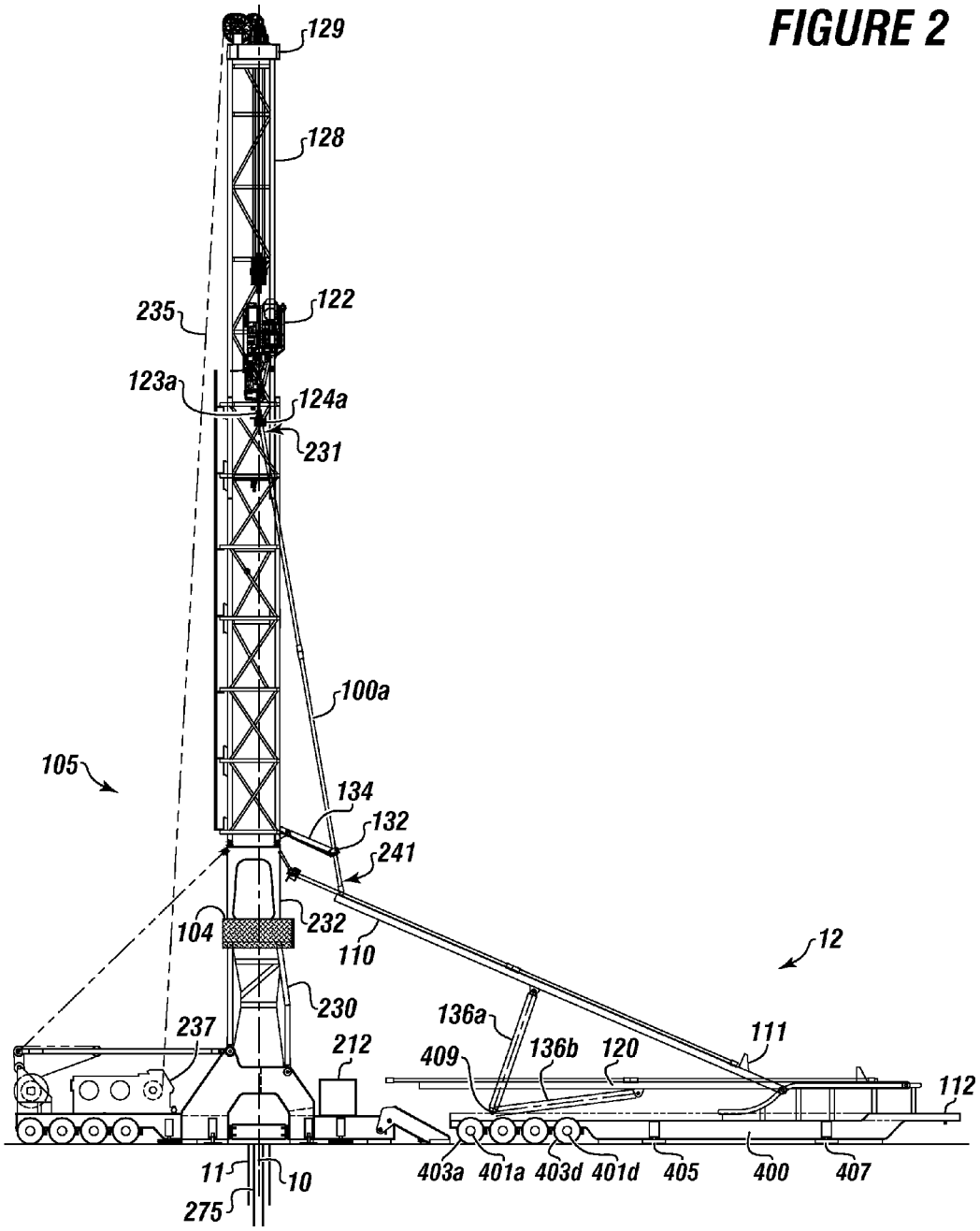
FIG. 2 depicts a side view of a catwalk mechanism in an operatively deployed position according to one or more embodiments.

FIG. 2 depicts a side view of a catwalk mechanism in an operatively deployed position connected to a drilling rig according to one or more embodiments.

The trailer 112 can have a strong, non-deforming frame 400 adapted to support over ten tons without deforming. The trailer 112 can have at least four axles, 401*a* and 401*d*. Each axle can have at least one pair of wheels 403*a* and 403*d*. The wheels can include tires. More than one pair of wheels and tires can be used per axle. FIG. 2 also shows that the trailer can have jacks 405 and 407 for stabilizing the trailer during operation.

The trailer 112 is shown adjacent the drilling rig 105 which is positioned over a well center 10 of a wellbore 11.

The catwalk mechanism 12 includes the catwalk 110, which can be connected to raising mechanisms 136*a* and 136*b* connected to the frame 400. The raising mechanisms can connect to the frame 400 with a pivot pin 409 or similar pivoting mechanism.

The raising mechanism 136*a* can raise the catwalk 110 on one end, to an elevation equivalent to the drill floor 104 of the drilling rig 105 while the other end of the catwalk 110 says connected to the trailer 112.

At least one of the raising mechanisms 136*a* and 136*b* can connect to the first loading arm, the second loading arm, or both the first and second loading arms of the catwalk mechanism 12 and the at least one of the raising mechanisms can be used for lifting and lowering the loading arms and the catwalk 110.

Raising mechanism 136*a* is shown raising the catwalk 110 and raising mechanism 136*b* can be used for lifting and lowing the loading arms, shown here with the ability to lift and lower the first loading arm 120, which can be positioned flush with the catwalk, once elevated to equivalent to the drill floor.

A catwalk feed start positioner 111 can be connected to the catwalk. The catwalk feed start positioner 111 can prevent the first tubular 100*a* and subsequent tubulars from sliding off the catwalk 110. The catwalk feed start position 111 can correctly position the tubulars for connection to an elevator connected to top drive links of the top dive.

The drilling rig 105, in an embodiment, can have a mast 128, which can be twin towers connected together, or a derrick.

The mast 128 can have a crown 129. The mast can be connected to a subbase 230 directly, or to a base which connects to a subbase.

The drill floor 104 is shown located between a base 232 and the subbase 230 of the drilling rig 105 in this embodiment, but can also be adjacent the mast.

A top drive 122 can be secured to the mast 128. The top drive can be slidably connected to the mast 128. A drill line 235 can be connected from a drawworks 237 to the top drive 122 through the crown 129.

The top drive 122 can have two top drive links but only top drive link 123*a* can be seen in this view. Each top drive link 123*a* can have an elevator 124*a* which is used to grab and hold a tubular during raising and lowering of the top drive.

The top drive 122 with top drive links and elevators can grab the tubular on a first end 231 to pull a tubular 100*a* along the catwalk 110. As the top drive 122 is hoisted by a drill line 235 powered from a drawworks 237, the top drive 122 raises the tubular 100*a* to a near parallel position to the mast 128.

In an embodiment, while the elevators are connected, the tubular is raised when the top drive is hoisted using the drill line, as pulled by the drawworks.

During hoisting, contact is maintained between a tubular on a second end 241 and the catwalk 110.

A pivoting tubular grabber 132, which can be attached to a tailing arm 134 can be used to grab the tubular at the second end 241 opposite the tubular first end 231. The tailing arm 134 can be secured to the mast 128. The pivoting tubular grabber 132 can actually engage the tubular using the tailing arm 134 mounted to the mast 128 on one end, and on the other end the pivoting tubular grabber 132. The tailing arm 134 is pivoted to guide the tubular near the second end 241 of the to the well center 10 while maintaining the tubular second end adjacent the drill floor 104.

Hydraulic tongs of the rig can be used to engage the second end of the tubular for making up a joint between the tubular and a drill string 275 in the wellbore.

A hydraulic power unit 212 can connect to the loading arms of the catwalk mechanism and to the raising mechanism for lifting and lowering the loading arms and catwalk.

In operation, the trailer 112 can be located adjacent the drilling rig 105, the catwalk 110 can be raised to an elevation equal to the drill floor 104, and the catwalk 110 can be loaded with the first tubular 100*a* using loading arm 120

Figure 3:
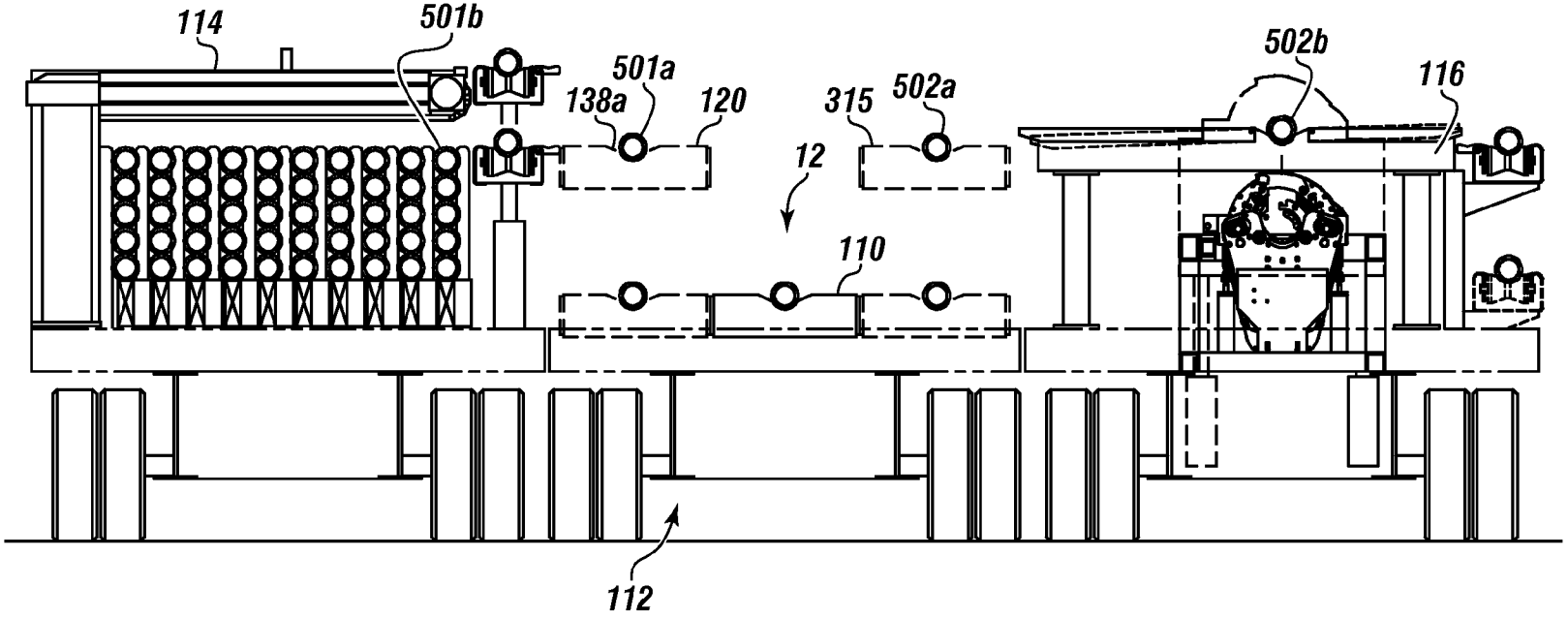
FIG. 3 depicts a front view of a catwalk mechanism in an operatively deployed position according to one or more embodiments.

FIG. 3 depicts a front view of a catwalk mechanism 12 in an operatively deployed position that can be used to perform one or more embodiments.

FIG. 3 shows and end view of the trailer 112 for raising the catwalk 110.

Tubular 501*a* rolls out of a pipe rack 114 onto a first loading arm 120 and rolling is stopped by a first loading arm feed start positioner 138*a*. The loading arm 120 is raised by hydraulic cylinder to be parallel and essentially aligned with the catwalk 110 which has already been raised. The tubular 501*a* is then rolled onto catwalk 110, stopped by a loading positioner 111 on the catwalk. The loading positioner moves the tubular first end up to connect to the elevator of the top drive of the drilling rig. As the tubular is pulled off the catwalk 110, another tubular, 502*a* can immediately roll out of the bucking machine 116 onto the second loading arm 315 for being placed into the catwalk 110 and raised to the top drive. Additional tubulars for repeating the steps are shown as tubulars 501*b* and 502*b*.

FIG. 4 depicts a flow diagram of an embodiment of the method for moving tubulars from the horizontal position to the vertical position to perform one or more drilling operations, production operations, workover operations, or combinations thereof.

The method can include raising a catwalk to an elevation equivalent to a drill floor of a drilling rig wherein the rig has a top drive slidably connected to the mast, and a drill line connected from a drawworks to the top drive through the crown, illustrated in box 601.

The method can also include rolling a tubular from a pipe rack or a bucking machine to one of a plurality of loading arms mounted to the trailer, illustrated in box 603.

The method can also include raising the loading arm to raise the tubular to a position flush with the catwalk, illustrated in box 605.

The method can also include rolling the tubular onto the catwalk from the loading arm, illustrated in box 607.

The method can also include extending a plurality of top drive links from the top drive, wherein the top drive links have an elevator, illustrated by box 609.

The method can also include grabbing a first end of the tubular with the elevators, illustrated in box 611.

The method can also include using the drawworks and drill line to hoist the tubular connected to the top drive while maintaining a connection between the tubular and the catwalk, illustrated in box 613.

The method can also include grabbing the tubular on a second end with a tailing arm connected to a pivoting tubular grabber, wherein the tailing arm is connected to the mast, illustrated in box 615.

The method can also include pivoting the tailing arm to guide the second end of the tubular to a well center while maintaining the second end of the tubular adjacent the drill floor, illustrated in box 617.

The method can also include connecting hydraulic tongs to the second end of the tubular, illustrated in box 619.

The method can also include lowering the top drive with the drawworks and drill line, enabling the second end of the tubular to connect with an end of a drill string in the wellbore, illustrated in box 621.

The method can also include disengaging the tubular from the catwalk, illustrated in box 623.

The method can also include making up the joint between the tubular and the drill string with the hydraulic tongs, illustrated in box 635.

The method can also include using a different loading arm raising an additional tubular from the pipe rack or bucking machine to the catwalk to sequentially perform step 601 to step 635 when the loading arm is rolling the tubular onto the catwalk, illustrated in box 637.

The method can also include repeating step 603 to step 637 until all needed tubulars for the drill string are installed in the wellbore.

The method can also include using a raising mechanism to raise the catwalk from the trailer.

The method can also include using a loading arm feed start positioner for each loading arm mounted on the trailer, and using the catwalk feed start positioner located on the catwalk to prevent each tubular from sliding, and to correctly position each tubular and wherein the catwalk feed start positioner slidably engages the tubular to prevent backsliding of the tubular off the loading arm or off the catwalk.

While these embodiments have been described with emphasis on the embodiments, it should be understood that within the scope of the appended claims, the embodiments might be practiced other than as specifically described herein.

What is claimed is:

1. A method for moving tubulars from a horizontal position to a vertical position over a well center of a wellbore, to perform one or more drilling operations, production operations, workover operations, or combinations thereof, wherein the method comprises:

a. raising a catwalk to an elevation equivalent to a drill floor of a drilling rig mounted on a trailer, wherein the drilling rig has a mast with crown connected to a subbase, a top drive slidably connected to the mast, and a drill line connected from a drawworks to the top drive through the crown;

b. rolling a tubular from a pipe rack or a bucking machine to a first loading arm, mounted to the trailer, wherein the first loading arm is positioned flush with the pipe rack or the bucking machine;

c. raising the first loading arm with the tubular to a position flush with the catwalk;

d. rolling the tubular from the first loading arm onto the catwalk;

e. extending a plurality of top drive links from the a top drive, the plurality of top drive links having an elevator;

f. grabbing a first end of the tubular with the elevator;

g. using the drawworks and the drill line, hoisting the tubular connected to the elevators of the top drive while maintaining a connection between the tubular and the catwalk;

h. grabbing the tubular on a second end with a tailing arm connected to a pivoting tubular grabber, wherein the tailing arm is connected to the mast;

i. pivoting the tailing arm to guide the second end of the tubular to a well center while maintaining the second end of the tubular adjacent the drill floor;

j. connecting hydraulic tongs to the second end of the tubular;

k. lowering the top drive with the drawworks and drill line, enabling the second end of the tubular to connect with an end of a drill string in the wellbore;

l. disengaging the tubular from the catwalk;

m. making up a joint between the tubular and the drill string with the hydraulic tongs;

n. using a second loading arm to raise a second tubular from the pipe rack or the bucking machine to the catwalk to sequentially perform step (b) to step (n), when the first loading arm is rolling the tubular onto the catwalk; and o. repeating step (b) to step (n), until all needed tubulars for the drill string are installed in the wellbore.

2. The method of claim 1, further comprising using a raising mechanism to raise the catwalk from the trailer.

3. The method of claim 1, further comprising using a loading arm feed start positioner for each loading arm mounted on the trailer, and using a catwalk feed start positioner located on the catwalk to prevent each tubular from sliding, and to correctly position each tubular and wherein the catwalk feed start positioner slidably engages the tubular to prevent backsliding of the tubular off each loading arm or off the catwalk.

* * * * *